US007690322B2

(12) United States Patent
Lanh

(10) Patent No.: US 7,690,322 B2
(45) Date of Patent: Apr. 6, 2010

(54) POLE/FINGER FLAG ASSEMBLY

(75) Inventor: Moeub Lanh, Tallahassee, FL (US)

(73) Assignee: Florida Agricultural and Mechanical University, Tallahasse ( * ) Notice: Subject to any disclaimer, the term of this patent is extended or adjusted under 35 U.S.C. 154(b) by 0 days.

(21) Appl. No.: 12/000,412

(22) Filed: Dec. 12, 2007

(65) Prior Publication Data

US 2008/0092798 A1 Apr. 24, 2008

Related U.S. Application Data

(63) Continuation-in-part of application No. 11/584,577, filed on Oct. 23, 2006.

(51) Int. Cl.
*G09F 17/00* (2006.01)

(52) U.S. Cl. ..... 116/173

(58) Field of Classification Search ..... 116/173
See application file for complete search history.

(56) References Cited

U.S. PATENT DOCUMENTS 1,670,176 A * 5/1928 Woolery ..... 116/35 R
2,646,796 A * 7/1953 Scholl ..... 602/60
3,308,479 A * 3/1967 Sesco, Jr. ..... 2/50
3,640,242 A * 2/1972 Guinn et al. ..... 116/173
3,902,509 A * 9/1975 Tundermann et al. ..... 433/142
4,369,215 A * 1/1983 Offen et al. ..... 428/4
5,324,581 A * 6/1994 Valencic ..... 428/124
5,571,020 A * 11/1996 Troudet ..... 434/233
6,057,501 A * 5/2000 Hale ..... 84/470 R
6,155,836 A * 12/2000 Hancock ..... 434/188
6,409,059 B1 * 6/2002 Calvert ..... 223/101
6,951,464 B2 * 10/2005 Cubeta et al. ..... 434/159
7,012,169 B2 * 3/2006 McDevitt et al. ..... 602/41

FOREIGN PATENT DOCUMENTS

GB 2249856 A * 5/1992

* cited by examiner

*Primary Examiner*—R. A. Smith
*Assistant Examiner*—Tania C Courson
(74) *Attorney, Agent, or Firm*—Norris, Melton, PLLC

(57) ABSTRACT

A flag capable of being unfurled or crested in the wind by use of a finger or flagpole comprising: first means for attaching the flag to a finger on a hand, and adjoining second means attached to the first means for attaching the flag to a flagpole; wherein the first means for attaching the flag to a finger comprises panels that sandwich an end section of the flag comprising a tubular member integrally attached to the panels, the tubular member having an inside diameter in an unstretched mode less than the outside diameter of a finger; and the adjoining tubular second means comprises a member for attaching the flag to a flagpole, the adjoining tubular member having an inside diameter in an unstretched mode less than the outside diameter of the flagpole.

16 Claims, 4 Drawing Sheets

POLE/FINGER FLAG ASSEMBLY

The present invention is a continuation-in-part of U.S. patent application Ser. No. 11/584,577 filed on Oct. 23, 2006 and relates to a pole/finger flag assembly, and more particularly, to a pole/finger flag assembly suited for attaching to either a finger or a pole as a banner, pennant, or anthem.

BACKGROUND OF THE INVENTION

I. Field of the Invention

II. Description of the Related Art

It is known that flags are a potent symbol of pride, whether it be for a country, state, city, a professional, collegiate or high school sports team, or for events such as a soccer championships or the Olympics.

U.S. Pat. No. 4,018,182 disclose a golf flag assembly that provides a pair of facing panel members adapted to receive one edge of a golf flag therebetween so that when the panel members are secured together, the golf flag is securely entrapped and sandwiched between the panel members.

An ornamental flag having a silhouette cut-out and having an assembly for suspending the flag from a flag pole in a manner that prevents the flag from becoming tangled or wrapped around the flag pole is disclosed in U.S. Pat. No. 5,533,464.

There is a need for enthusiasts wishing to exhibit symbols of pride, either nationally or for prominent events in support of professional teams, college or high school teams and for occasions such as major tennis tournaments, the Olympics and World Cup soccer contests to have a choice between holding the flag banner by a pole or a finger without having to switch flags.

SUMMARY OF THE INVENTION

One object of the present invention is to provide a pole/finger flag assembly that overcomes the disadvantages of previously known flags utilized as a symbol of pride and support for sporting and other events.

Another object of the present invention is to provide a pole/finger flag assembly that overcomes the disadvantages of previously known flags utilized as a symbol of pride and support for sporting and other events, that allows either a pole or a finger to hold the same flag banner in an upright position so that the flag might crest in the wind.

A further object of the present invention is to provide a pole/finger flag assembly that overcomes the disadvantages of previously known flags utilized as a symbol of pride and support for sporting and other events, that can be inconspicuously and conveniently be carried in a wallet, bill fold, or a pocket prior to use, but nevertheless admits use of a pole or a finger to be inserted to enable the same flag to crest in the wind.

The foregoing and other objects of the invention will become more apparent by reference to the brief description of the drawings and detailed description of the preferred embodiment of the invention.

DETAIL DESCRIPTION OF PREFERRED EMBODIMENT OF THE INVENTION

In general, the invention encompasses a single flag capable of being unfurled or crested in the wind using either a flagpole or a finger. The flag comprises first means for attaching the flag to a finger on a hand, and adjoining second means attached to the first means for attaching the flag to a flagpole; wherein the first means for attaching the flag to a finger comprises panels that sandwich an end section of the flag comprising a tubular member integrally attached to the panels, the tubular member having an inside diameter in an unstretched mode less than the outside diameter of a finger; and the adjoining tubular second means comprises a member for attaching the flag to a flagpole, the adjoining tubular member having an inside diameter in an unstretched mode less than the outside diameter of the flagpole.

The attaching means is a resilient material, and may be cloth and the tubular material is elastic.

The method of unfurling or cresting the single flag with provisions for a finger or a flag pole support comprises: placing a first tubular member adjoining a second tubular member of a flag on the finger of a hand; the flag comprising: first means for attaching the flag to a finger on a hand, and adjoining second means attached to the first means for attaching the flag to a flagpole; wherein the first means for attaching the flag to a finger comprises panels that sandwich an end section of the flag comprising a tubular member integrally attached to the panels, the tubular member having an inside diameter in an unstretched mode less than the outside diameter of a finger; and the adjoining tubular second means comprises a member for attaching the flag to a flagpole, the adjoining tubular member having an inside diameter in an unstretched mode less than the outside diameter of the flagpole.

Another method of unfurling or cresting the single flag with provisions for a finger or flag pole support comprises: placing a second tubular member adjoining a first tubular member of a flag on a flag pole; the flag comprising: first means for attaching the flag to a finger on a hand, and adjoining second means attached to the first means for attaching the flag to a flagpole; wherein the first means for attaching the flag to a finger comprises panels that sandwich an end section of the flag comprising a tubular member integrally attached to the panels, the tubular member having an inside diameter in an unstretched mode less than the outside diameter of a finger; and the adjoining tubular second means comprises a member for attaching the flag to a flagpole, the adjoining tubular member having an inside diameter in an unstretched mode less than the outside diameter of the flagpole.

Figure 1:
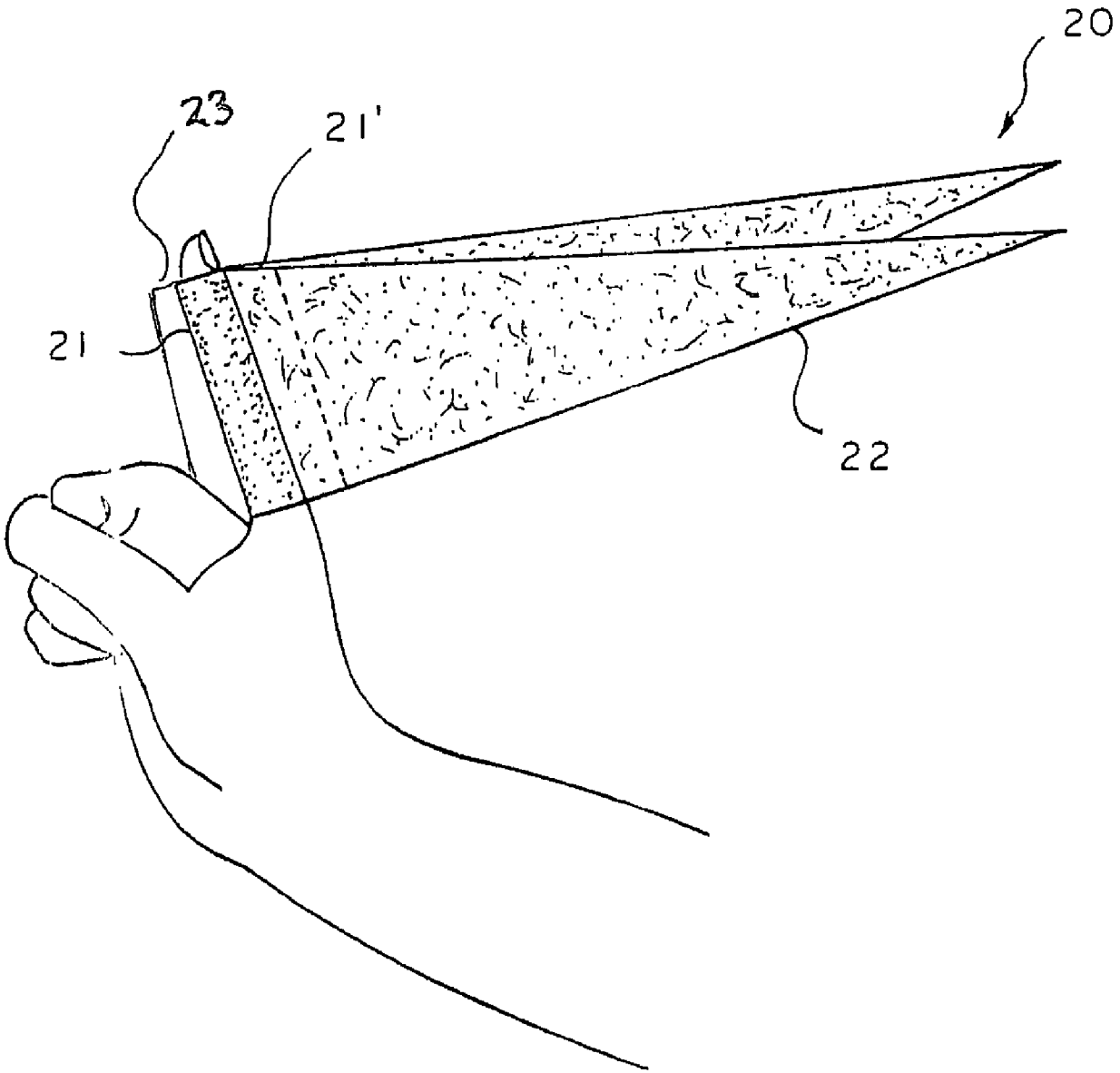
FIG. 1 is a perspective view of the pole/finger flag assembled with a finger to enable it to crest in the wind.

Reference is now made to FIG. 1 of the finger flag assembly 20 positioned over an index finger to enable it to unfurl upon waving or wind gust. The flag assembly 20 will have emblazoned thereon an indicia (not shown) that is suitable for the particular event for which enthusiasm is shown. The flag assembly may be constructed of any flexible material, but most preferably, cloth. However, the tubular attachment means 21 and 21' is formed of an elastic material secured to the flag 22 by any conventional means, such as heat sealing, stitching or Velcro fastening. Similarly, the tubular attachment 23 to accommodate insertion of a flagpole is also made of an elastic material; and this elastic material has an inside diameter in an unstretched mode less than the outside diameter of the flagpole.

Preferably, attachment means 21 is in a tubular shape, wherein the tubular member is open at both ends to accommodate positioning the flag 20 over any finger of the hand. The tubular member attachment means 21 and the panels 21' are an integral piece stitched or other wise held fast by conventional means to the flag 20.

The elastic tubular attachment means 21 is constructed so that its inside diameter is smaller than the outside diameter of any finger over which the flag is positioned, thereby assuring good grasp of the tubular member to the finger.

Figure 2:
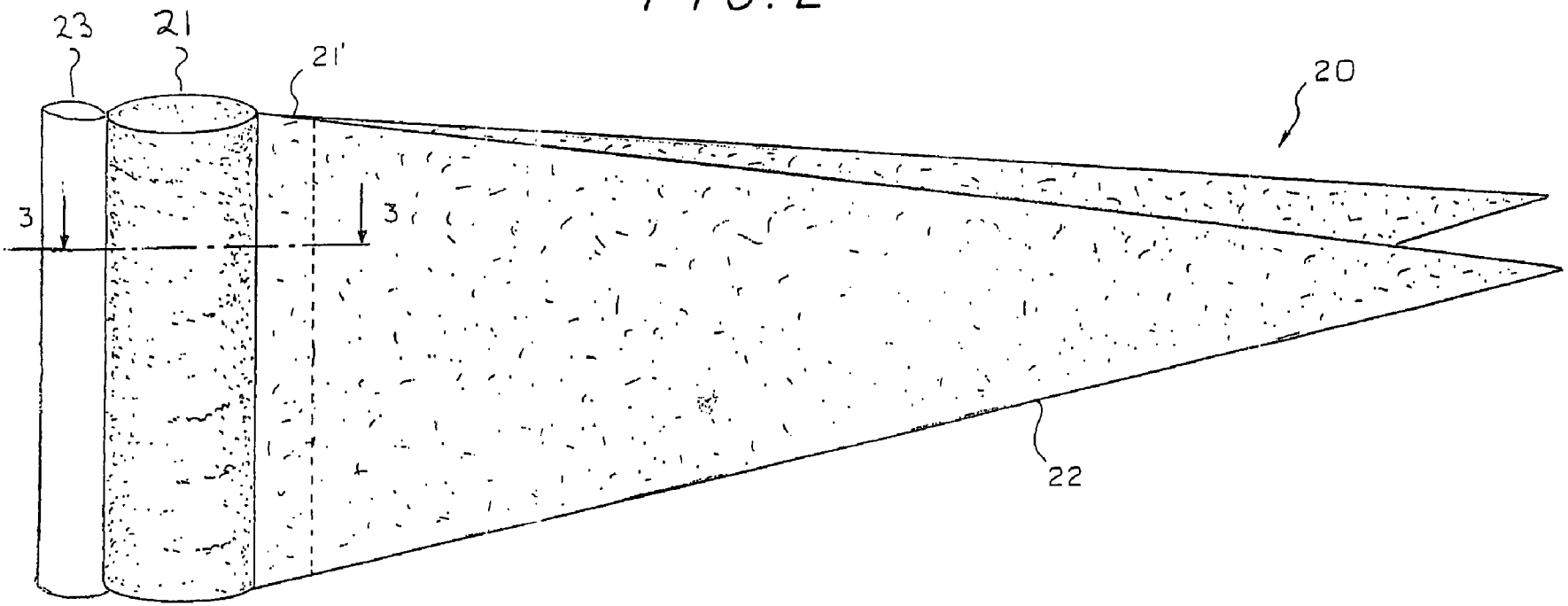
FIG. 2 is a view in perspective of the pole/finger flag assembly of the invention when not in assembly with a finger on a hand or a pole.

FIG. 2 is a view in perspective of the flag of the invention when not in assembly with a finger on a hand or in a assembly with a flag pole.

Figure 3:
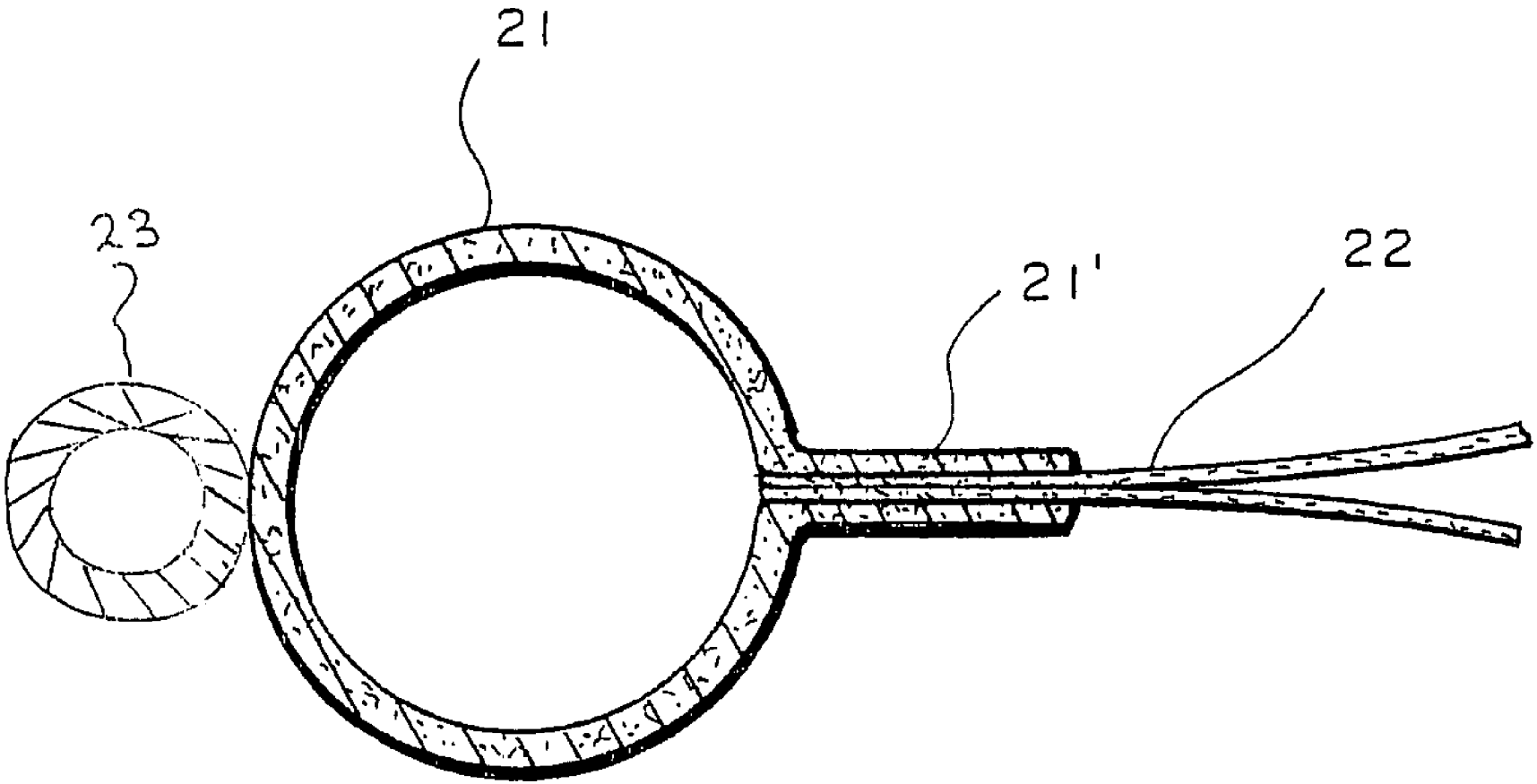
FIG. 3 is a fragmentary cross-section view along line 3-3 of FIG. 1.
Figure 4:
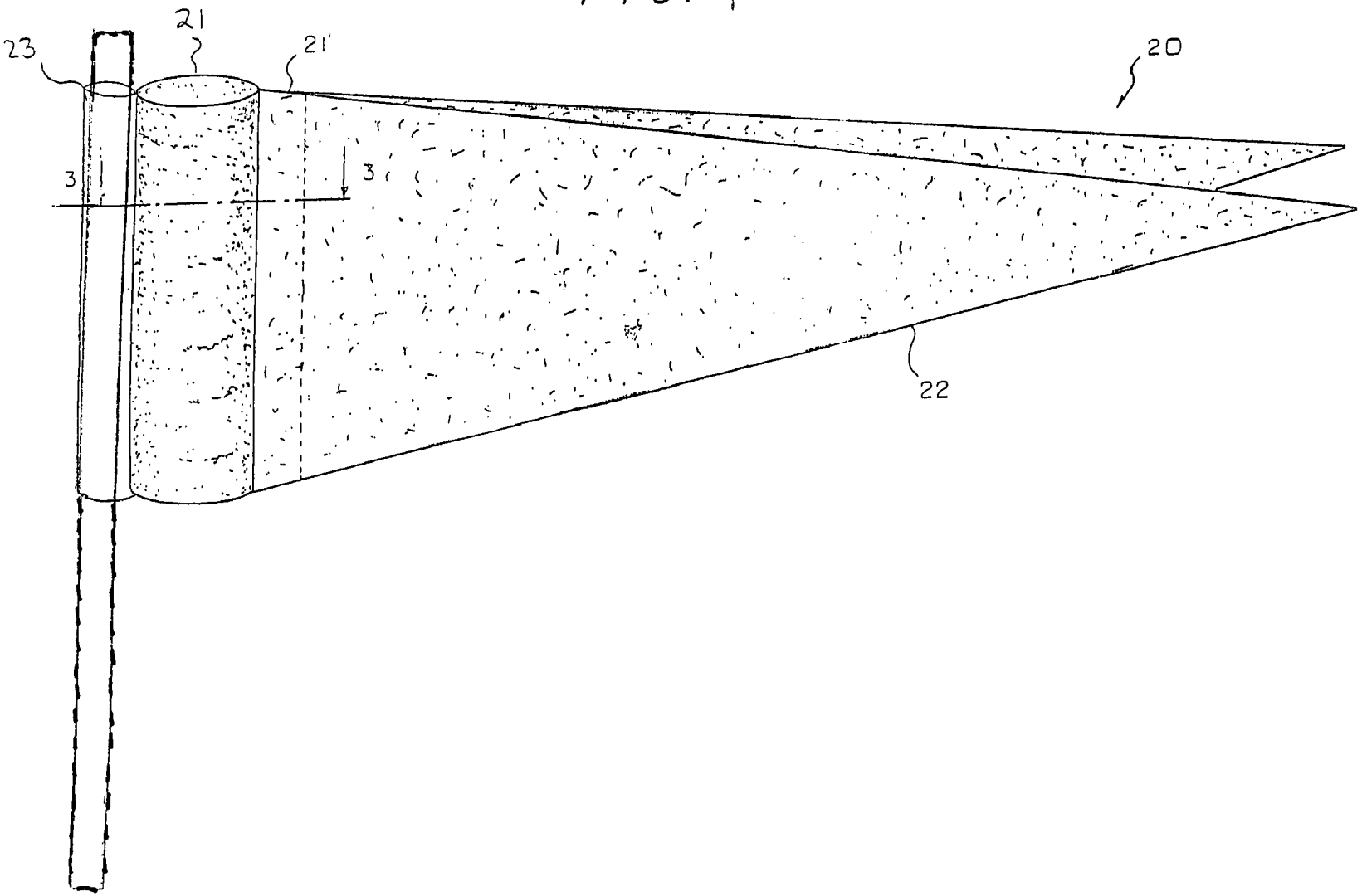
FIG. 4 is a view in perspective of the pole/finger flag assembly of the invention.

FIG. 3 is a fragmentary cross-section view along line 3-3 of FIG. 1, and showing the adjoining flag pole tubular attachment 23, which may be attached to the finger tubular attachment by any conventional means, such as heat sealing, stitching or Velcro fastening.

When not in use on a finger in support of an event, the flag may be folded so that it fits into a wallet, bill fold, pocketbook or even one's pocket.

While the invention has been described by reference to preferred embodiments, it will be apparent to those skilled in the art that modifications thereto can be made without departing from the spirit of the invention as defined by the scope of the claims hereafter appended.

The invention claimed is:

1. A flag capable of being unfurled or crested in the wind by use of a finger or a flagpole comprising:

first means for attaching said flag to a finger on a hand, and adjoining second means attached to said first means for attaching said flag to a flagpole; wherein said first means for attaching said flag to a finger comprises panels that sandwich an end section of said flag comprising a first tubular member integrally attached to said panels, said tubular member having an inside diameter in an unstretched mode less than the outside diameter of a finger; and said adjoining tubular second means comprises a second tubular member for attaching said flag to said flagpole, said adjoining second tubular member having an inside diameter in an unstretched mode less than the outside diameter of said flagpole.

2. The flag of claim 1 wherein said first and second attaching means and tubular members is a resilient material.

3. The flag of claim 2 wherein said resilient material is a cloth.

4. The flag of claim 3 wherein said first and second tubular member is elastic.

5. In combination, an assembly of a finger on a hand inserted in a first tubular member of a flag, wherein said flag comprises first means for attaching said flag to said finger on said hand, and adjoining second means attached to said first means for attaching said flag to a flagpole; wherein said first means for attaching said flag to said finger comprises panels that sandwich an end section of said flag comprising a first tubular member integrally attached to said panels, said tubular member having an inside diameter in an unstretched mode less than the outside diameter of said finger; and said adjoining tubular second means comprises a second tubular member for attaching said flag to said flagpole, said adjoining second tubular member having an inside diameter in an unstretched mode less than the outside diameter of said flagpole.

6. The combination of claim 5 wherein said first and second attaching means and tubular means is a resilient material.

7. The combination of claim 6 wherein the resilient material is cloth.

8. The combination of claim 7 wherein said first and second tubular material is elastic.

9. In combination, an assembly of a flagpole inserted in a second tubular member of a flag, wherein said flag comprises first means for attaching said flag to a finger on said hand, and adjoining second means attached to said first means having said flagpole inserted in its second tubular member; wherein said first means for attaching said flag to said finger comprises panels that sandwich an end section of said flag comprising a first tubular member integrally attached to said panels, said first tubular member having an inside diameter in an unstretched mode less than the outside diameter of said; said adjoining tubular second means having an inside diameter in an unstretched mode less than the outside diameter of said flagpole.

10. The combination of claim 9 wherein said first and second attaching means and tubular members is a resilient material.

11. The combination of claim 10 wherein the resilient material is cloth.

12. The combination of claim 11 wherein said first and second tubular material is elastic.

13. A method of unfurling or cresting a flag with provisions for a finger or a flag pole for support in the wind without the use of a flag pole, comprising: a) placing a first tubular member adjoining a second tubular member of said flag on the finger of a hand; said flag comprising: first means for attaching said flag to said finger on said hand, and adjoining second means attached to said first means for attaching said flag to said flagpole; wherein said first means for attaching said flag to said finger comprises panels that sandwich an end section of said flag comprising a first tubular member integrally attached to said panels, said tubular member having an inside diameter in an unstretched mode less than the outside diameter of said finger; and said adjoining tubular second means comprises a second tubular member for attaching said flag to said flagpole, said adjoining second tubular member having an inside diameter in an unstretched mode less than the outside diameter of said flagpole.

14. The method of claim 13 wherein the hand is waved back and forth.

15. A method of unfurling or cresting a flag in the wind with provisions for a finger or a flag pole for support in the wind, comprising: a) placing a second tubular member adjoining a first tubular member of said flag on said flag pole; said flag comprising: first means for attaching said flag to said finger on a hand, and adjoining second means attached to said first means for attaching said flag to said flagpole; wherein said first means for attaching said flag to said finger comprises panels that sandwich an end section of said flag comprising a first tubular member integrally attached to said panels, said tubular member having an inside diameter in an unstretched mode less than the outside diameter of said finger; and said adjoining tubular second means comprises a second tubular member for attaching said flag to said flagpole, said adjoining second tubular member having an inside diameter in an unstretched mode less than the outside diameter of said flagpole.

16. The method of claim 15 wherein the flag pole is waved back and forth.

* * * * *